US012213584B2

(12) United States Patent
Joo

(10) Patent No.: US 12,213,584 B2
(45) Date of Patent: Feb. 4, 2025

(54) MASCARA BRUSH AND METHOD FOR MANUFACTURING SAME

(71) Applicant: Jinwoong Joo, Seoul (KR)

(72) Inventor: Jinwoong Joo, Seoul (KR)

( * ) Notice: Subject to any disclaimer, the term of this patent is extended or adjusted under 35 U.S.C. 154(b) by 721 days.

(21) Appl. No.: 17/299,768

(22) PCT Filed: Jun. 7, 2019

(86) PCT No.: PCT/KR2019/006882
§ 371 (c)(1),
(2) Date: Jun. 3, 2021

(87) PCT Pub. No.: WO2020/246645
PCT Pub. Date: Dec. 10, 2020

(65) Prior Publication Data

US 2022/0015534 A1 Jan. 20, 2022

(30) Foreign Application Priority Data

Jun. 4, 2019 (KR) ..... 10-2019-0066088

(51) Int. Cl.
*A46D 3/04* (2006.01)
*A46B 9/02* (2006.01)

(52) U.S. Cl.
CPC ..... *A46D 3/045* (2013.01); *A46B 9/021* (2013.01); *A46B 2200/1053* (2013.01)

(58) Field of Classification Search
CPC ..... A46D 3/045; A46D 3/04; A46B 9/021; A46B 3/06
See application file for complete search history.

(56) References Cited

FOREIGN PATENT DOCUMENTS

| | | | | |
|---|---|---|---|---|
| JP | 3049165 | U | | 6/1998 |
| JP | 2003-250633 | A | | 9/2003 |
| JP | 2008-154819 | A | | 7/2008 |
| JP | 2012-075723 | A | | 4/2012 |
| JP | 5723564 | B2 | * | 5/2015 |
| KR | 10-2019-0042332 | A | | 4/2019 |
| KR | 10-2028834 | B1 | | 10/2019 |

OTHER PUBLICATIONS

International Search Report for PCT/KR2019/006882 mailed Apr. 2, 2020 from Korean Intellectual Property Office.

* cited by examiner

*Primary Examiner* — Shay Karls
(74) *Attorney, Agent, or Firm* — Revolution IP, PLLC

(57) ABSTRACT

A mascara brush includes: a brush rod part having a brush formed in a certain pattern; a handle connected to the other end of the brush rod part; and a liquid container into which the brush rod part having the brush is inserted, wherein the brush rod part comprises: a brush rod having a certain length of a slot with a certain interval, and a brush including a certain pattern of filaments, wherein the certain pattern of filaments are inserted into and adhered to the slot.

12 Claims, 13 Drawing Sheets

(a)

(b)

MASCARA BRUSH AND METHOD FOR MANUFACTURING SAME

CROSS REFERENCE TO PRIOR APPLICATIONS

This application is a National Stage Application of PCT International Patent Application No. PCT/KR2019/006882 filed on Jun. 7, 2019, under 35 U.S.C. § 371, which claims priority to Korean Patent Application No. 10-2019-0066088 filed on Jun. 4, 2019, respectively, which are all hereby incorporated by reference in their entirety.

TECHNICAL FIELD

The present invention relates to a mascara brush and a method for manufacturing the same, and more particularly, to a mascara brush and a method for manufacturing the same manufactured by combining filaments formed in various patterns with a body of the mascara brush.

BACKGROUND ART

Generally, mascara refers to a kind of cosmetic used by women, and refers to a cosmetic that shows off the appearance of the eye by applying various colors of liquids on eyelashes using a brush. Such mascara is configured by a container in which a mascara liquid is stored, a handle for opening and closing the container, a rod-type support protruding to the lower part of the handle, and a brush formed on the support, and has been used by applying the mascara liquid on the brush by coupling or separating the handle and the container.

A mascara brush corresponding to a structure consisting of the support and the brush has been manufactured according to various functions, such as volume (an effect of making eyelashes enriching), curl (an effect of rolling up ends of the eyelashes), long lash (an effect of making the length of eyelashes long), and clean (an effect of preventing eyelashes from being stuck) for the eyelashes according to a length and a shape of hair.

As such, the mascara brush needs to evenly apply a mascara liquid having viscosity on the eyelashes and needs to have a combing function by the brush so that the eyelashes are not stuck to each other.

The mascara brush serves to fix the eyelashes in various shapes using the mascara liquid, and has a disadvantage that a brushing effect of the mascara is reduced even if the position of the brush is regular. Further, even in the case of an integrated mascara brush, there was a problem that it is very difficult to make an irregular form of brush, and by assembling and manufacturing a plurality of brushes to make the irregular form of brush, there is a problem that manufacturing cost is expensive.

Further, a conventional mascara brush is formed of long bristles and irregularly arranged bristles, but in this case, since the brushing function of the brush is insufficient, the mascara liquid applied on the eyelashes is frequently aggregated at any part, and as a result, there was a problem that after applying the mascara, the aesthetic sense of eyelashes is rather inhibited.

DISCLOSURE

Technical Problem

The present invention is derived to solve the above problems, and an object of the present invention is to provide a mascara brush and a method for manufacturing the same which is simply manufactured while various shapes of brushes may be formed.

Technical Solution

According to an aspect of the present invention, there is provided a mascara brush comprising: a brush rod part formed with a certain pattern of brush; a handle connected to the other end of the brush rod part; and a liquid container into which the brush rod part having the brush is inserted, wherein the brush rod part comprises: a brush rod having a certain length of a slot with a certain interval, and a brush comprising a certain pattern of filaments, wherein the certain pattern of filaments are inserted into and adhered to the slot.

In the present invention, one or more slots may be formed.

The brush may be formed by attaching one side of the filaments to an adhesive tape to form a certain pattern, inserting the certain pattern of filaments into the slot to adhere the certain pattern of filaments together with the slot with an adhesive or through vibration fusion or thermal fusion, and then cutting and removing the adhesive tape portion.

The brush may be formed by dividing the filaments into two parts with a strap made of the same material as the filaments to form a pattern, adhering the strap of the two parts with the pattern with an adhesive to form a certain pattern of filaments, inserting the certain pattern of filaments attached to the strap into the slot to adhere the filaments together with the slot with the adhesive or through vibration fusion or thermal fusion.

The brush may be formed by tying the filaments with the strap to form a certain pattern, inserting the certain pattern of filaments into the slot to adhere the certain pattern of filaments together with the slot with an adhesive or through vibration fusion or thermal fusion, and then cutting and removing the strap portion.

The brush rod may be configured by a connection body connected with a handle, a slot body formed to extend to the other side of the connection body, and one or more slots formed with a certain length on the slot body.

The brush rod may be configured by one side body formed in a predetermined length, the other side body formed to be symmetrical with the one side body, and a folding part formed to be foldable so that ends of the one side body and the other side body are connected to each other, wherein the one side body and the other side body may be folded to form a slot.

The brush rod may be configured by an upper body having any one side formed in a flat plate, and a lower body having any one side formed in a flat plate so as to be folded with the flat plate of the upper body, wherein the upper body and the lower body may be folded to form a slot.

In the present invention, longitudinal strap insertion grooves may be provided on the flat plates of the upper body and the lower body.

The mascara brush may further comprise a central body between the upper body and the lower body, wherein the central body may have strap insertion grooves formed on an upper surface and a lower surface thereof, respectively, and the upper body, the central body, and the lower body may be folded to form a slot.

The brush may have a cutting line in which the end is cut in a straight shape, a convex shape, a concave shape, a shape combined with the convex shape and the concave shape, and a zigzag shape, or maintain an original shape without forming the cutting line.

According to another aspect of the present invention, there is provided a method for manufacturing a mascara brush using a brush rod formed in a certain length and with a slot into which a certain pattern of filaments are inserted, the method comprising the steps of (a) forming a certain pattern of filaments by attaching the filaments to an adhesive tape; (b) inserting the certain pattern of filaments into the slot; (c) forming a brush by injecting an adhesive into the slot or vibration-fusing or thermal-fusing the slot when the certain pattern of filaments are inserted into the slot; and (d) cutting and removing the portion attached with the adhesive tape from the brush rod formed with the brush.

According to another aspect of the present invention, there is provided a method for manufacturing a mascara brush using a brush rod formed in a certain length and with a slot into which a certain pattern of filaments are inserted, the method comprising the steps of: (a) forming a certain pattern of filaments by attaching the filaments to a strap or tying the filaments with the strap; (b) inserting the certain pattern of filaments into the slot; (c) forming a brush by injecting an adhesive into the slot inserted with the certain pattern of filaments or vibration-fusing or thermal-fusing the slot; and (d) cutting and removing the strap portion attached with the filaments or tied with the filaments from the brush rod formed with the brush.

According to yet another aspect of the present invention, there is provided a method for manufacturing a mascara brush using a brush rod configured by an upper body having any one side formed with a flat plate into which a strap is inserted into a longitudinal center and a lower body having a flat plate corresponding to the flat plate of the upper body, the method comprising the steps of: (a) forming a certain pattern of filaments by attaching the filaments to a strap or tying the filaments with the strap; (b) disposing the strap formed with the certain pattern of filaments on the flat plate of the lower body to have a certain pattern at one side or both sides; (c) disposing a flat plate of the upper body on the flat plate of the lower body disposed with the certain pattern of filaments; and (d) forming a brush by injecting an adhesive into the upper body and the lower body disposed with the certain pattern of filaments or vibration-fusing or thermal-fusing the upper body and the lower body.

According to yet another aspect of the present invention, there is provided a method for manufacturing a mascara brush using a brush rod configured by an upper body having any one side formed with a flat plate into which a strap is inserted into a longitudinal center and a lower body having a flat plate corresponding to the flat plate of the upper body, the method comprising the steps of: (a) forming a certain pattern of filaments into two parts by attaching the filaments to the strap or tying the filaments with the strap; (b) adhering the certain pattern of filaments to be positioned in opposite directions to each other by attaching the strap of the two parts formed with the certain pattern of filaments with each other with an adhesive; (c) disposing the certain pattern of filaments on the lower body by inserting the strap attached with the adhesive into the strap insertion groove formed on the lower body and disposing the upper body on the lower body disposed with the certain pattern of filaments; and (d) forming a brush by injecting the adhesive into the upper body and the lower body disposed with the certain pattern of filaments or ultrasonic-fusing or thermal-fusing the upper body and the lower body.

According to yet another aspect of the present invention, there is provided a method for manufacturing a mascara brush using a brush rod configured by an upper body having a strap insertion groove into which a strap is inserted into a longitudinal center, a lower body having a strap insertion groove into which a strap is inserted into a longitudinal center, and a central body disposed between the upper body and the lower body and having an upper surface and a lower surface with strap insertion grooves corresponding to the upper body and the lower body, the method comprising the steps of: (a) forming a certain pattern of filaments into two parts by tying the filaments with a strap; (b) adhering the certain pattern of filaments to be positioned in opposite directions to each other by adhering the straps of the two parts formed with the certain pattern of filaments to each other with an adhesive; (c) disposing the certain pattern of filaments on the lower body by inserting the strap attached with the adhesive into the strap insertion groove formed on the lower body and disposing the central body on the lower body disposed with the certain pattern of filaments; disposing the certain pattern of filaments on the central body by inserting the strap attached with the adhesive into the strap insertion groove formed on the upper surface of the central body; and disposing the upper body on the central body disposed with the certain pattern of filaments; and (d) forming a brush by injecting the adhesive into the upper body disposed with the certain pattern of filaments, the central body, and the lower body or vibration-fusing or thermal-fusing the upper body, the central body and the lower body.

The method may further comprise (e) forming a certain shape of cutting line by cutting an end of the brush in a certain shape when the brush is adhered to the brush rod.

Advantageous Effects

According to the present invention, there is an advantage that a brush rod for fixing filaments is separately formed and a brush is formed by adhering or vibration-fusing or thermal-fusing the filaments to a separately formed fixing body to manufacture a brush with various patterns.

Further, the mascara brush according to the present invention has an advantage that the brush rod and the brush may be separately manufactured to enable a mass production.

Further, the mascara brush according to the present invention has an advantage that since the brush is not massed but evenly unfolded to attach a predetermined amount of mascara to user's eyelashes, the use amount of mascara is reduced, thereby enabling the production of beautiful eyelashes.

BEST MODE OF THE INVENTION

According to best aspect of the present invention, there is provided a method for manufacturing a mascara brush using a brush rod formed in a certain length and with a slot into which a certain pattern of filaments are inserted, the method comprising the steps of: (a) forming a certain pattern of filaments by attaching the filaments to an adhesive tape; (b) inserting the certain pattern of filaments into the slot; (c) forming a brush by injecting an adhesive into the slot or vibration-fusing or thermal-fusing the slot when the certain pattern of filaments are inserted into the slot; and (d) cutting and removing the portion attached with the adhesive tape from the brush rod formed with the brush.

MODES FOR THE INVENTION

Hereinafter, preferred embodiments of the present invention will be described in detail with reference to the accompanying drawings. However, the preferred embodiments are intended to describe the present invention in detail so that those skilled in the art can easily implement the invention, but it is not understood that the technical spirit and the scope of the present invention are limited.

Figure 1:
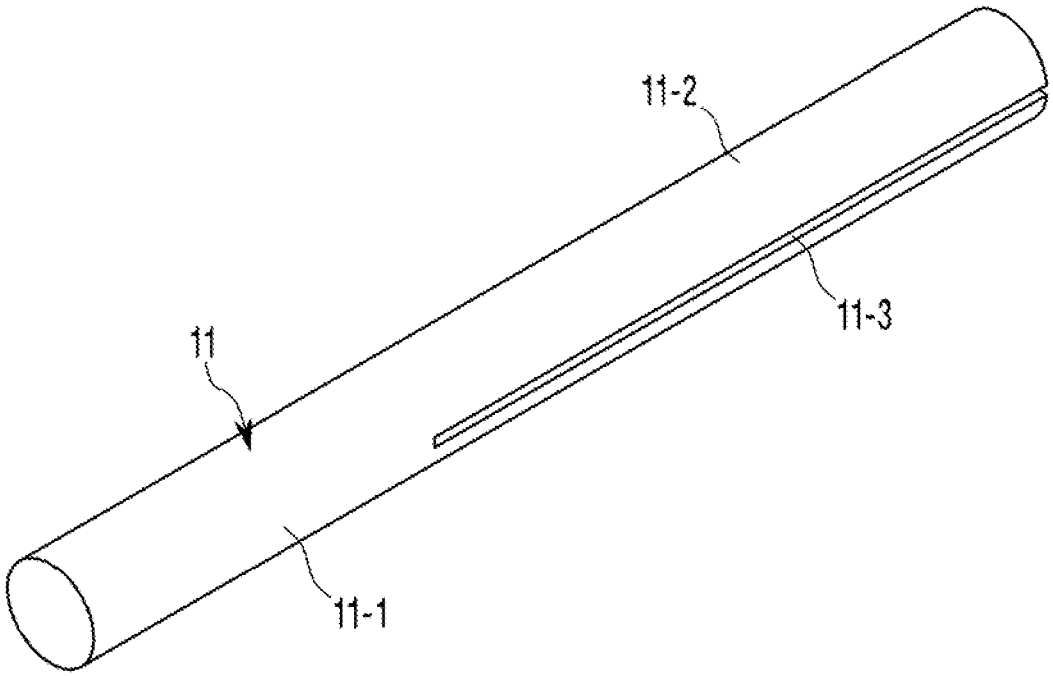
FIG. 1 is a perspective view of a first embodiment of a brush rod according to the present invention.
Figure 2:
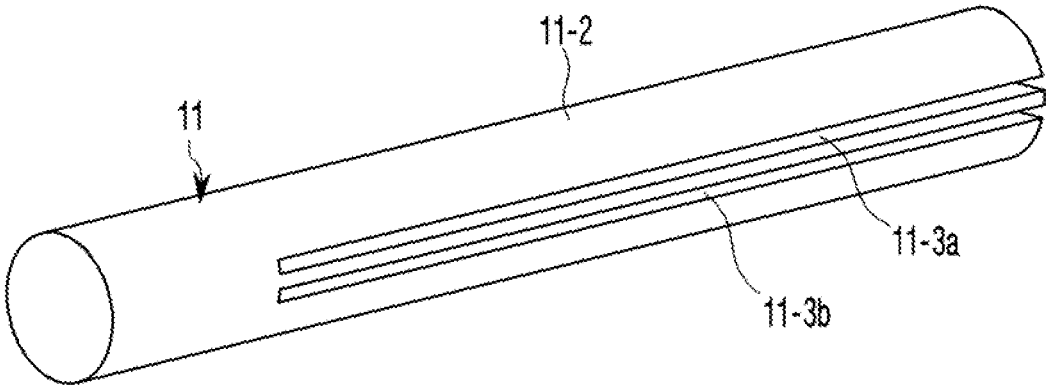
FIG. 2 is a perspective view of a slot added in the first embodiment of the brush rod according to the present invention.
Figure 3:
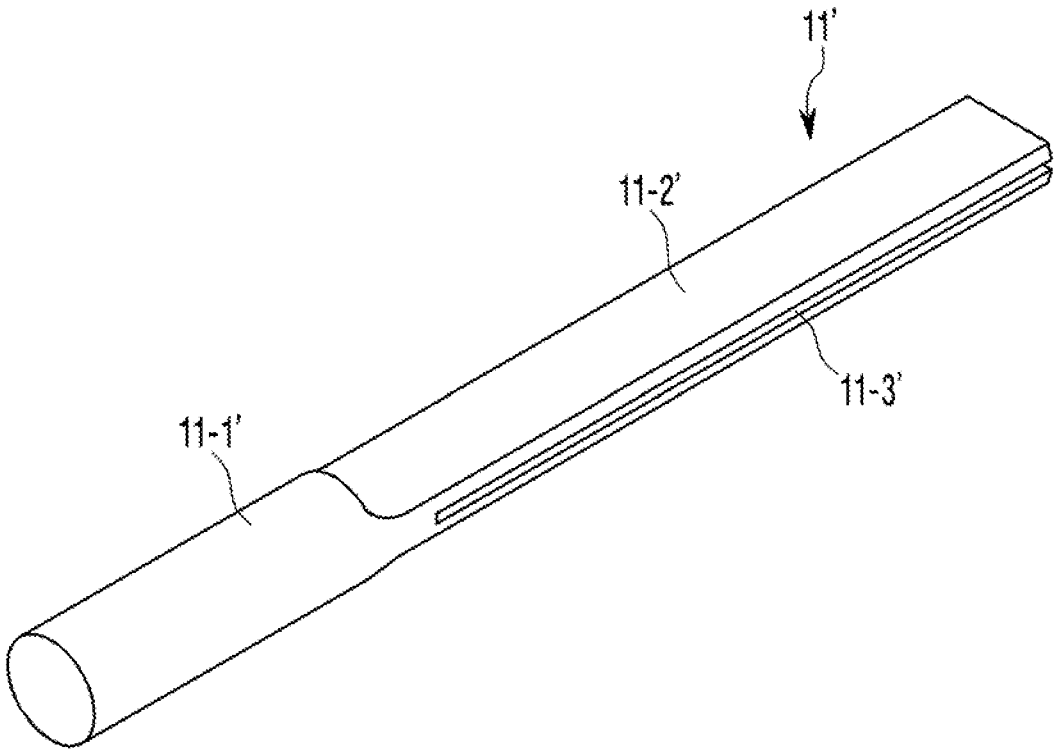
FIG. 3 is a perspective view of a second embodiment of a brush rod according to the present invention.
Figure 4:
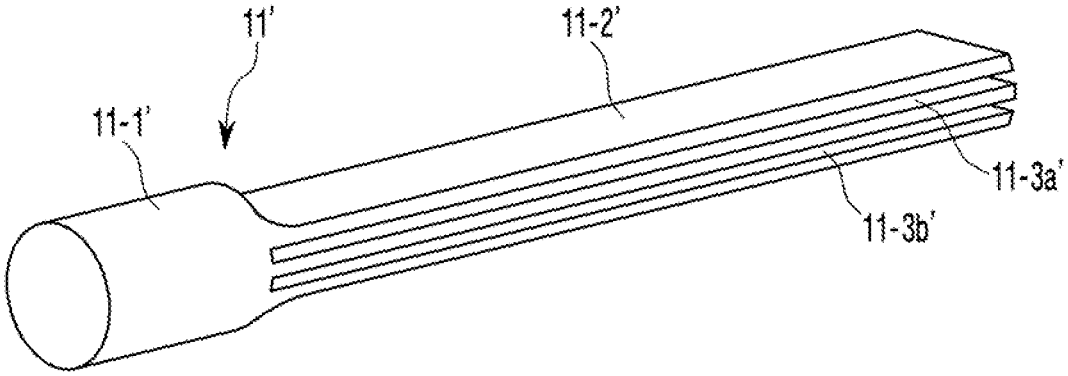
FIG. 4 is a perspective view of a slot added in the second embodiment of the brush rod according to the present invention.
Figure 5:
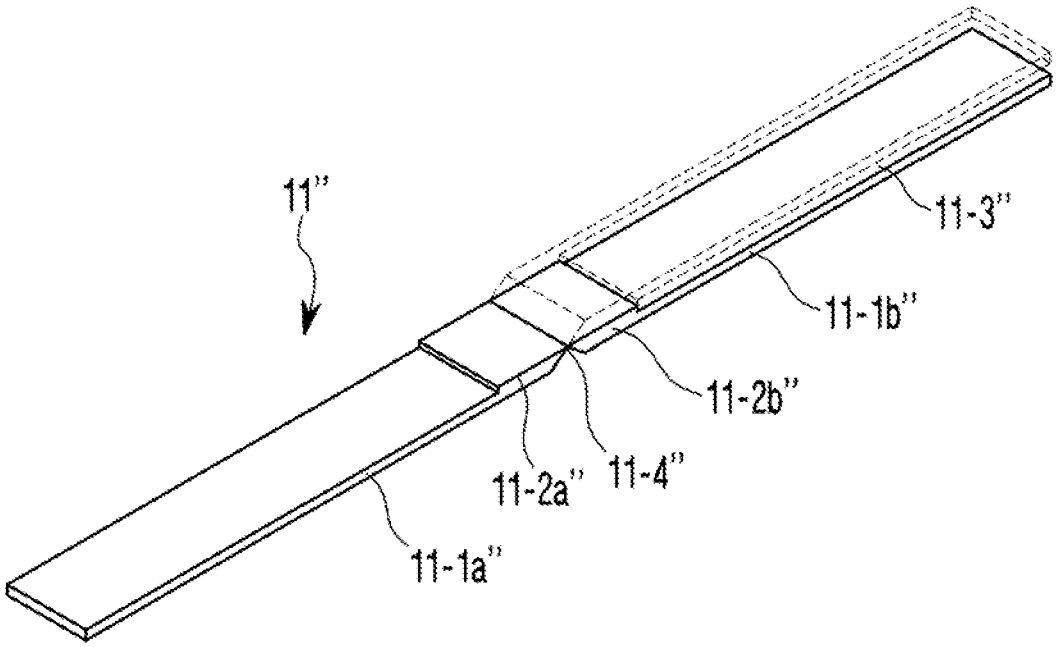
FIG. 5 is a perspective view of a third embodiment of a brush rod according to the present invention.
Figure 6:
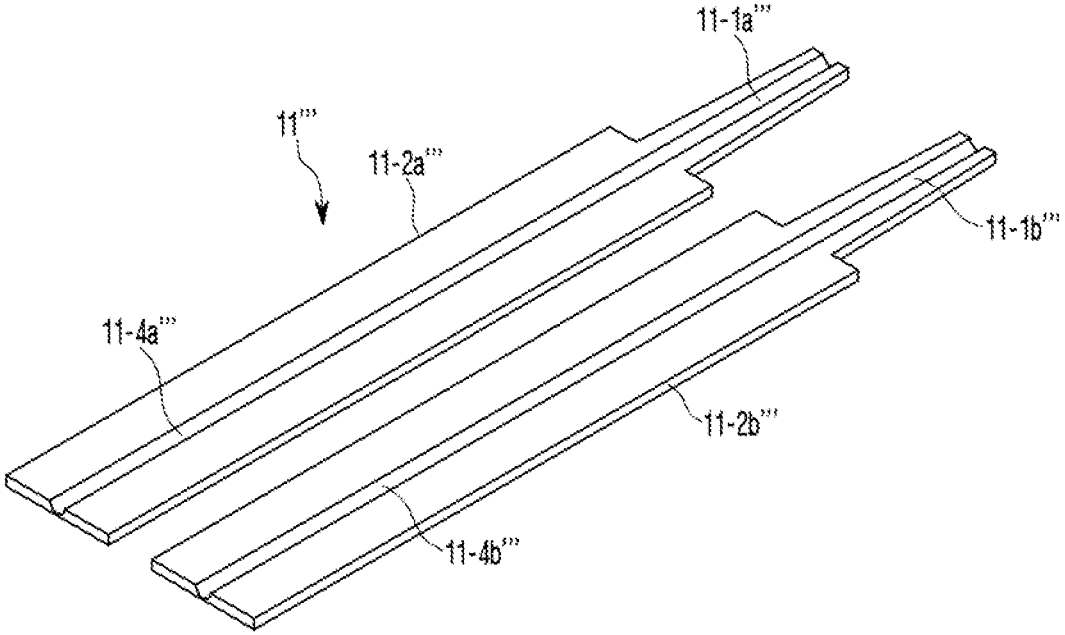
FIG. 6 is a perspective view of a fourth embodiment of a brush rod according to the present invention.
Figure 6:
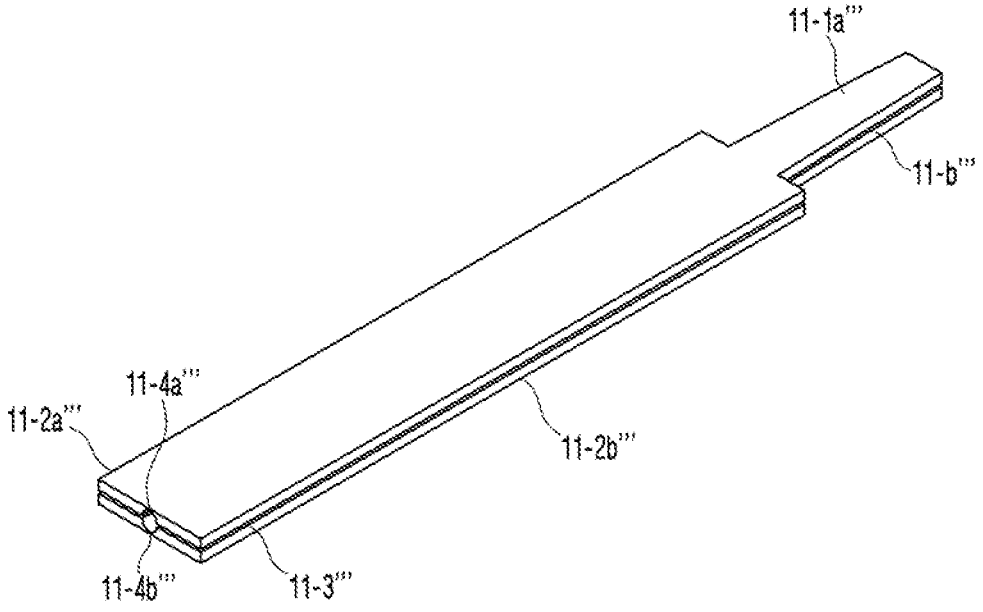
Figure 7:
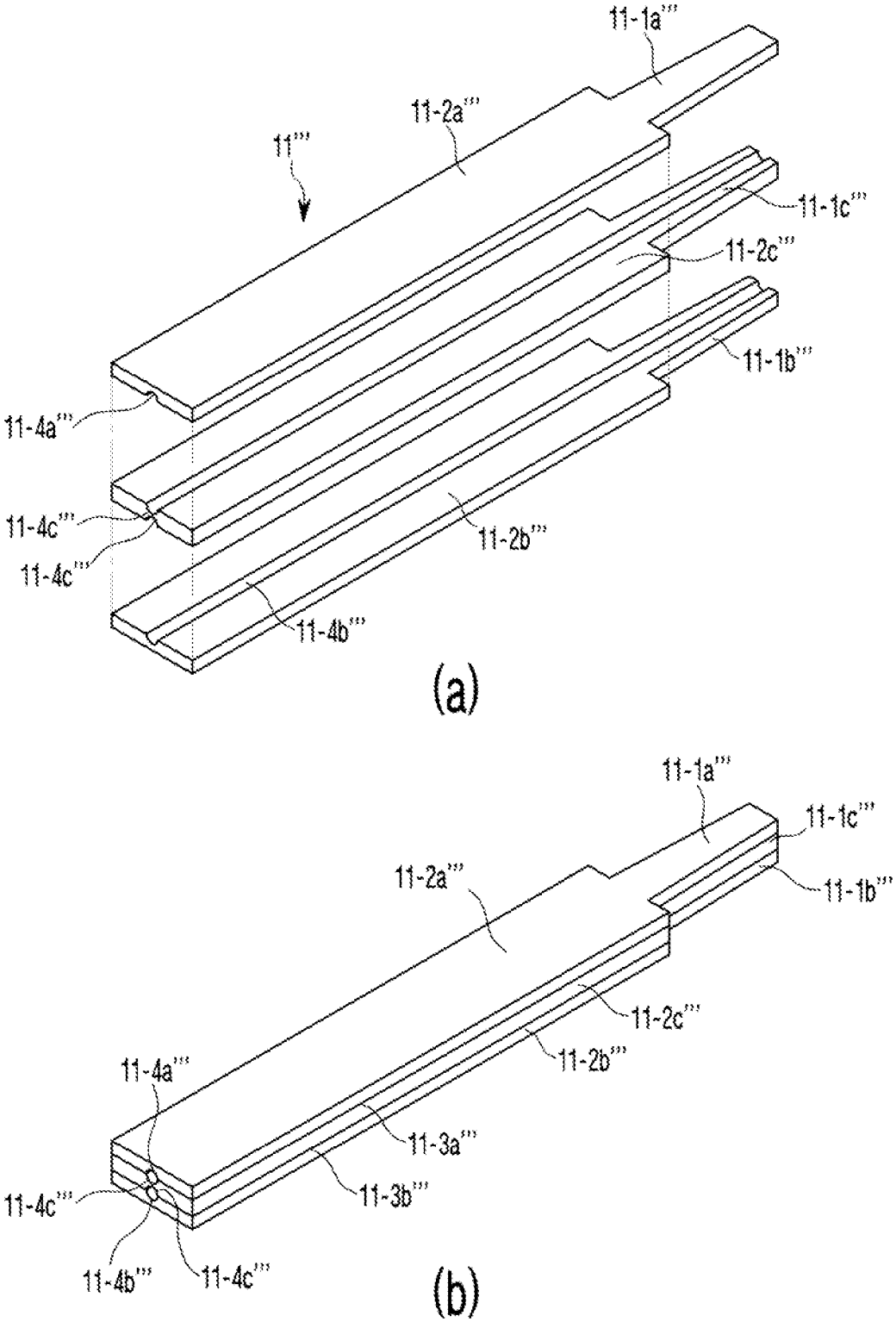
FIG. 7 is a perspective view of a slot added in the fourth embodiment of the brush rod according to the present invention.
Figure 8:
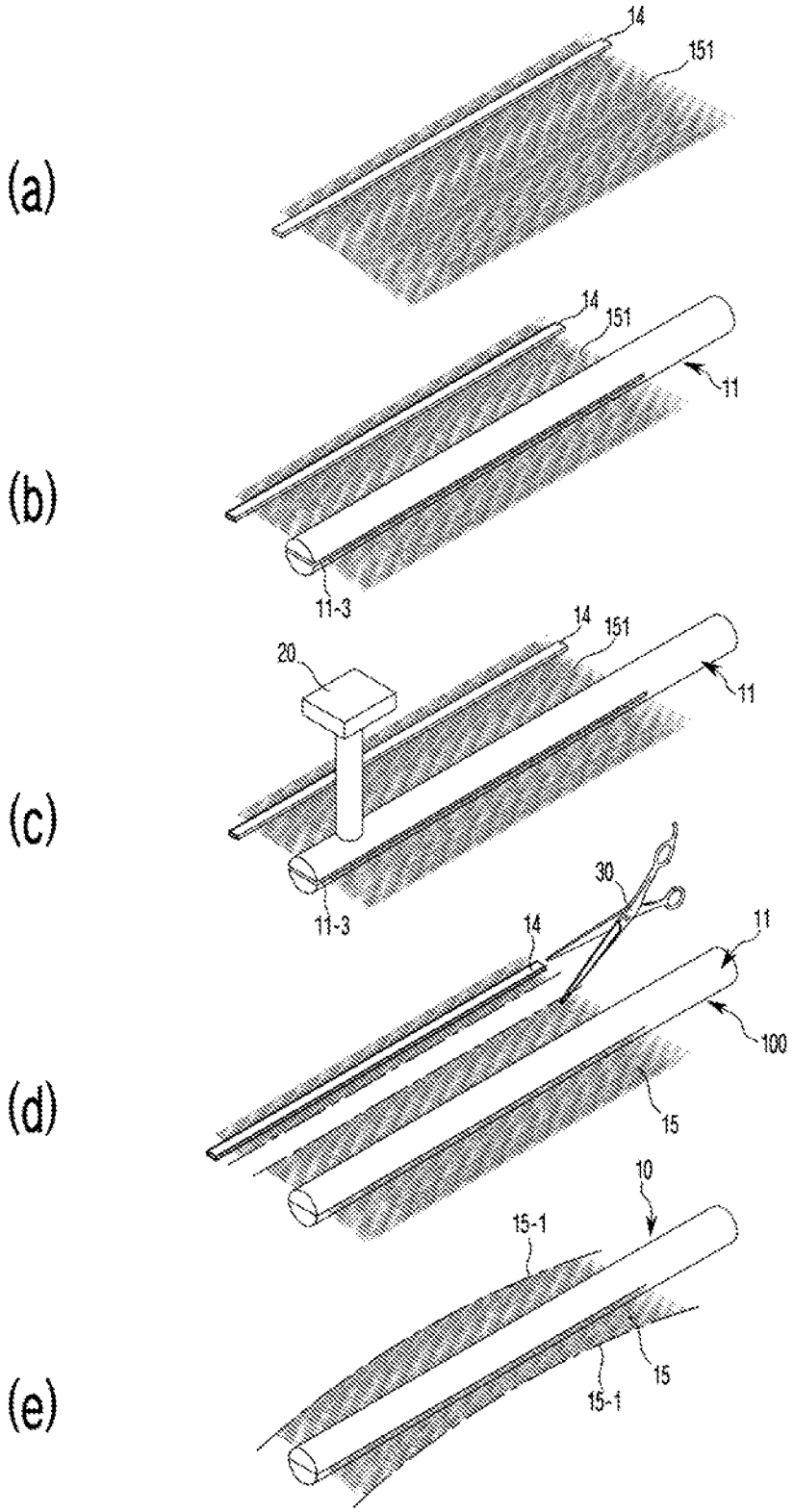
FIG. 8 is a perspective view of a first embodiment of a method for manufacturing a mascara brush according to the present invention.
Figure 9:
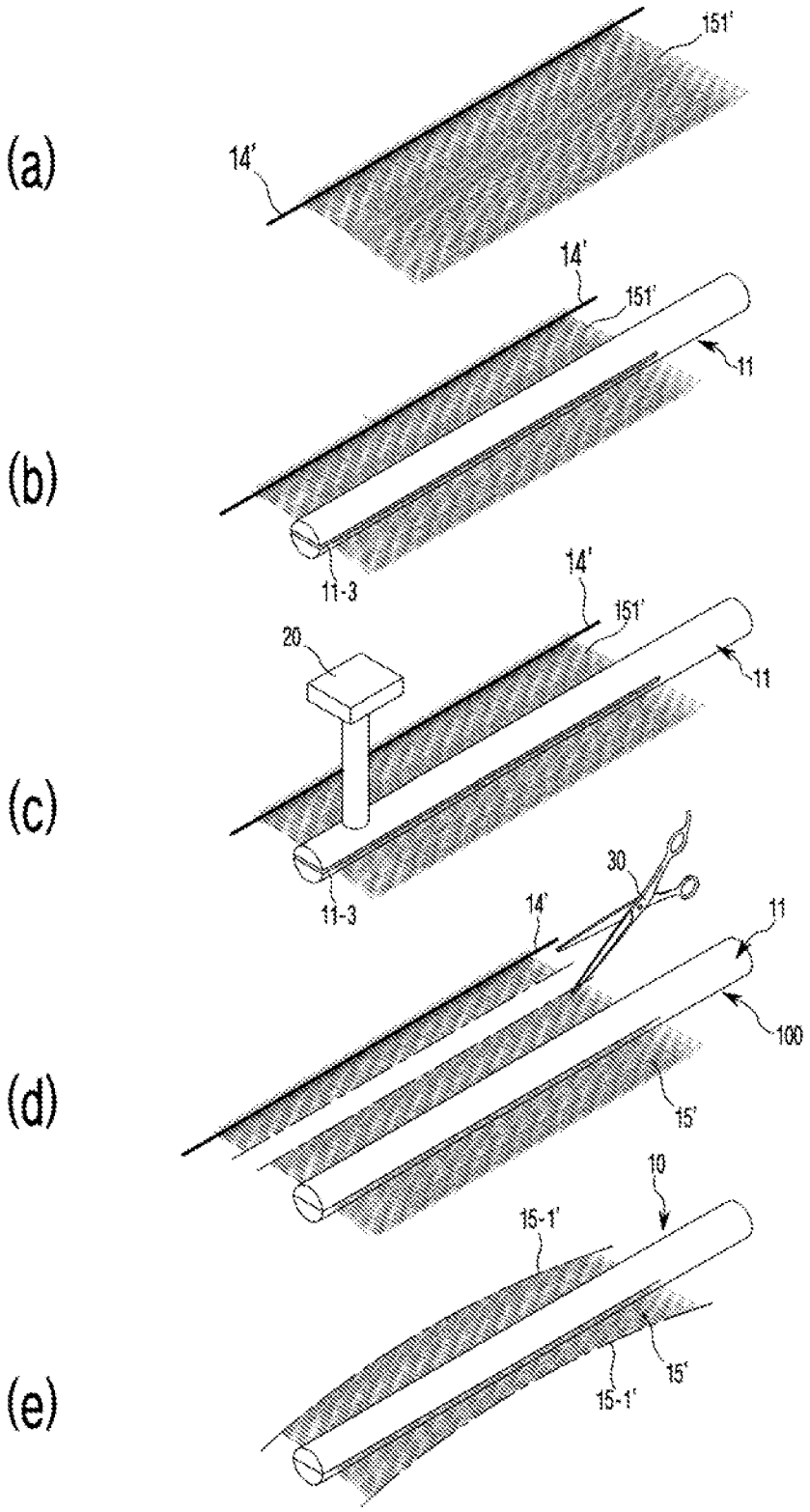
FIG. 9 is a perspective view of a second embodiment of a method for manufacturing a mascara brush according to the present invention.
Figure 10:
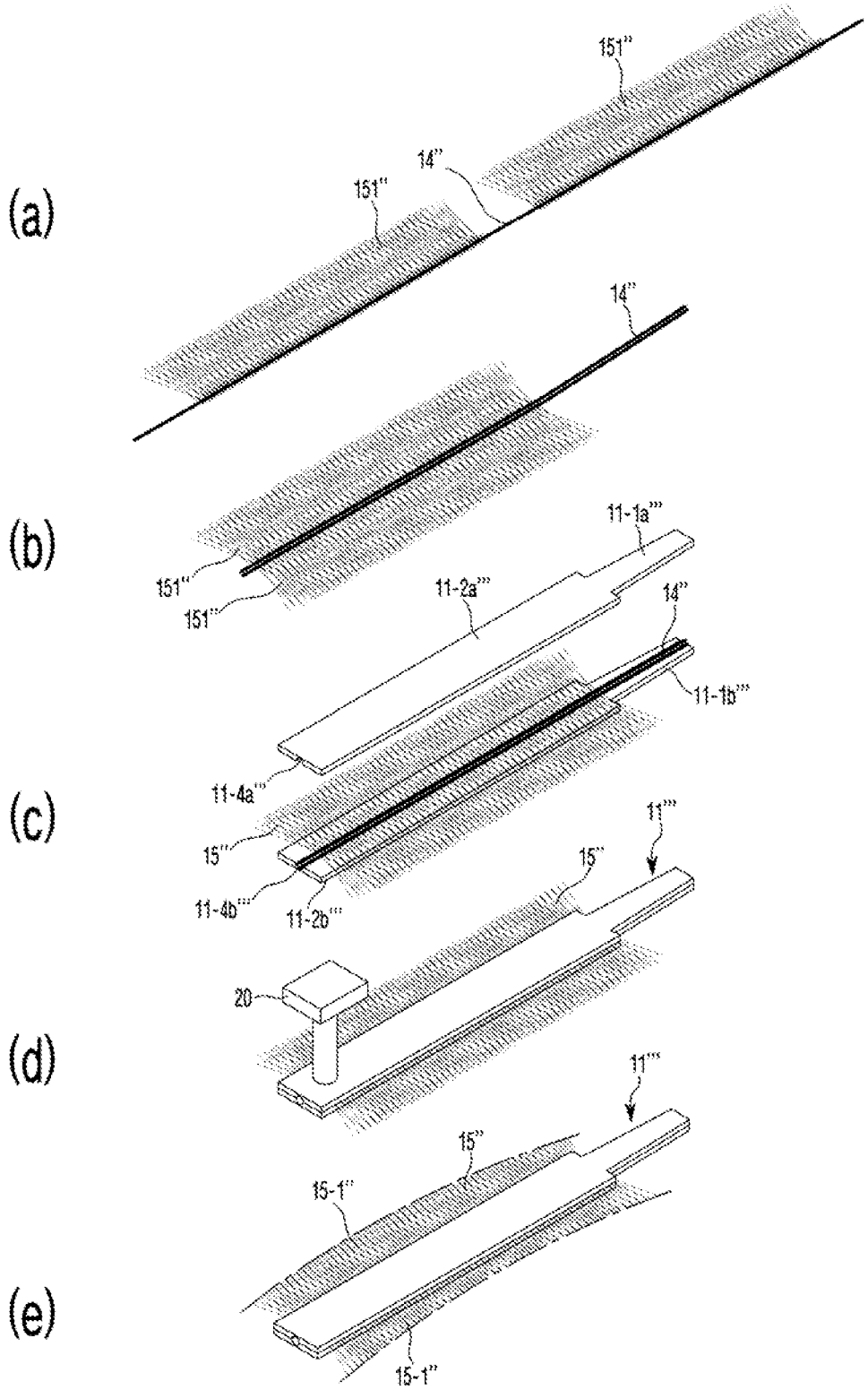
FIG. 10 is a perspective view of a third embodiment of a method for manufacturing a mascara brush according to the present invention.
Figure 11:
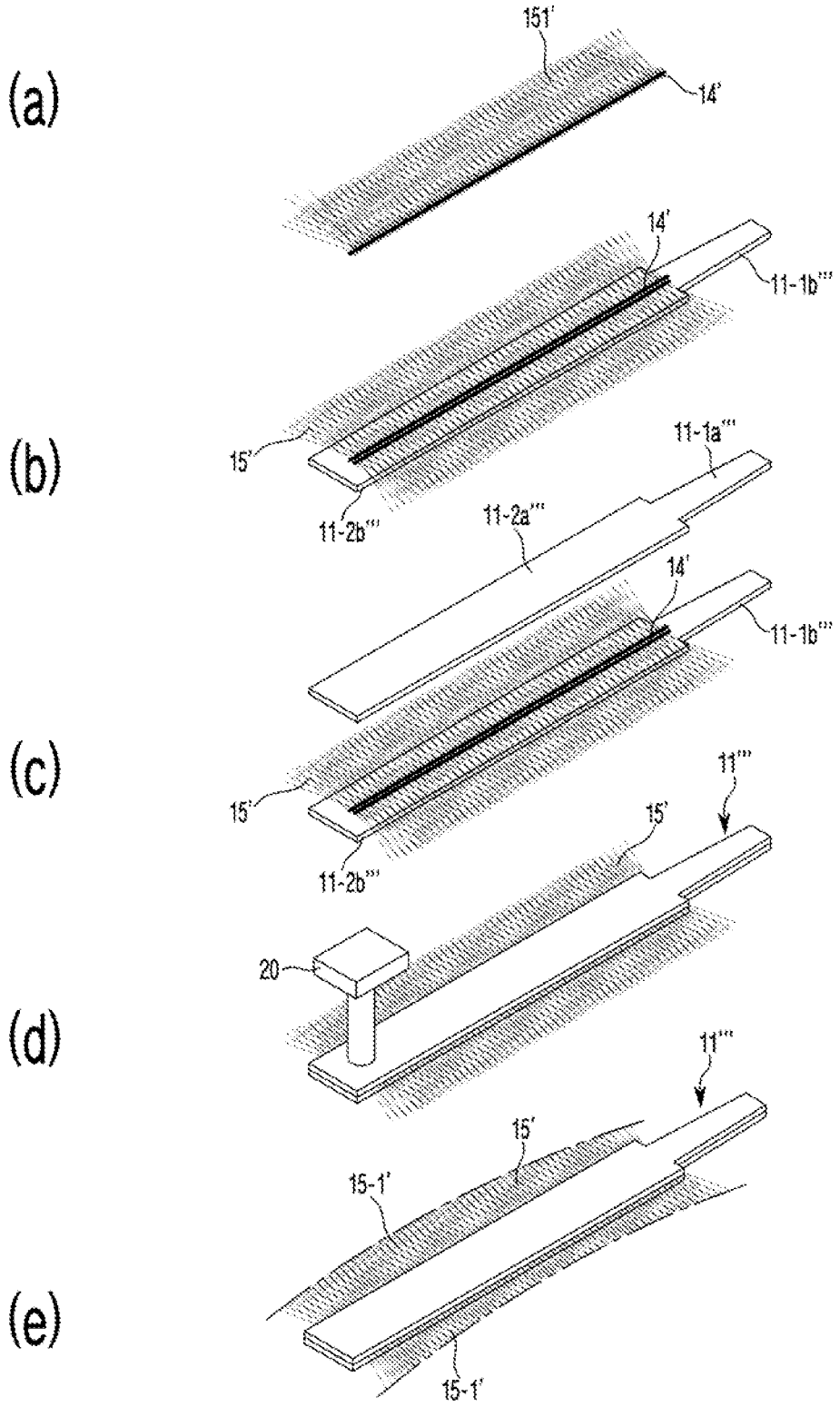
FIG. 11 is a perspective view of a fourth embodiment of a method for manufacturing a mascara brush according to the present invention.
Figure 12:
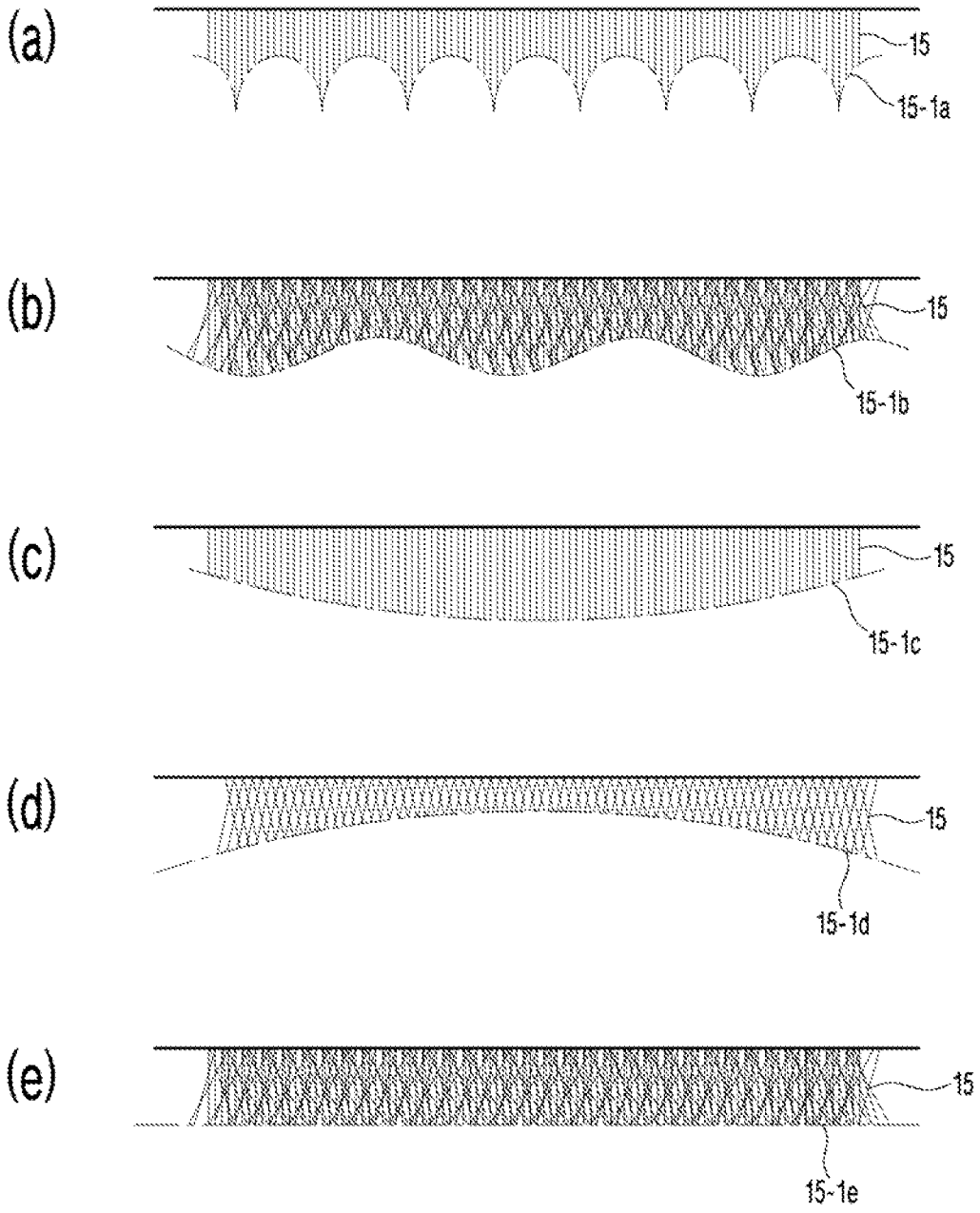
FIG. 12 is a cross-sectional view for embodiments of a cutting line of a brush end part according to the present invention.
Figure 13:
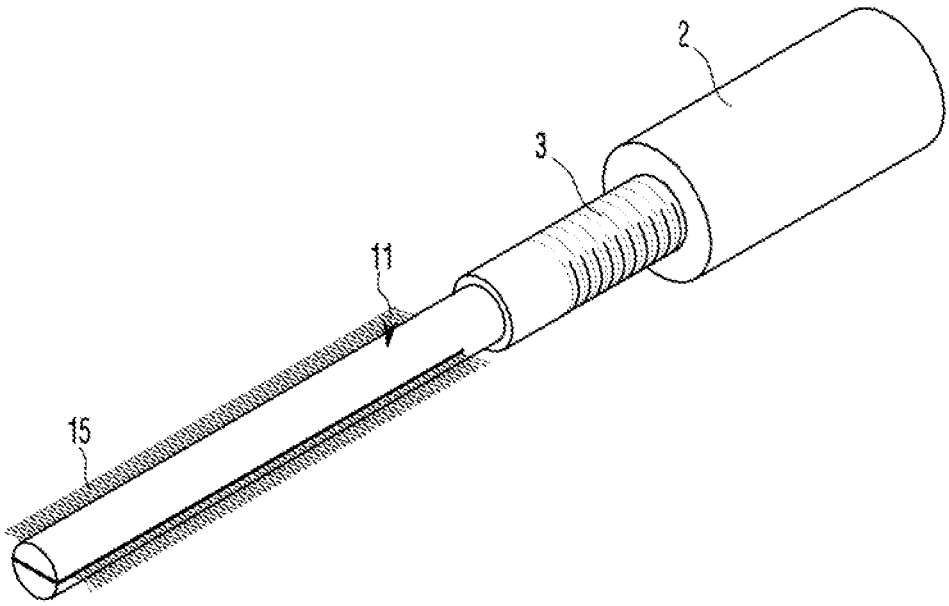
FIG. 13 is a perspective view of a first embodiment of a brush rod part according to the present invention which is connected to a handle.
Figure 14:
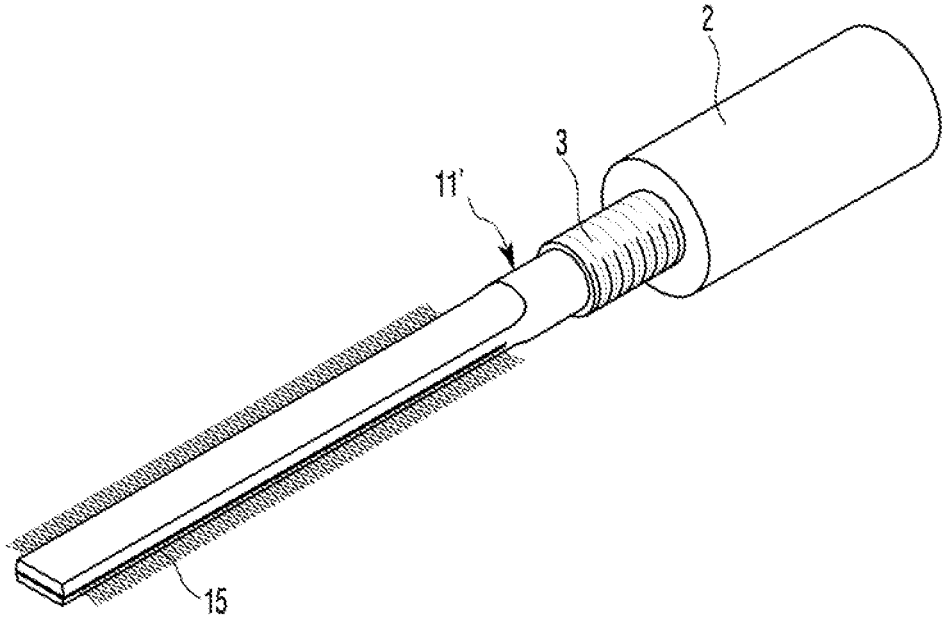
FIG. 14 is a perspective view of a second embodiment of a brush rod part according to the present invention which is connected to a handle.
Figure 15:
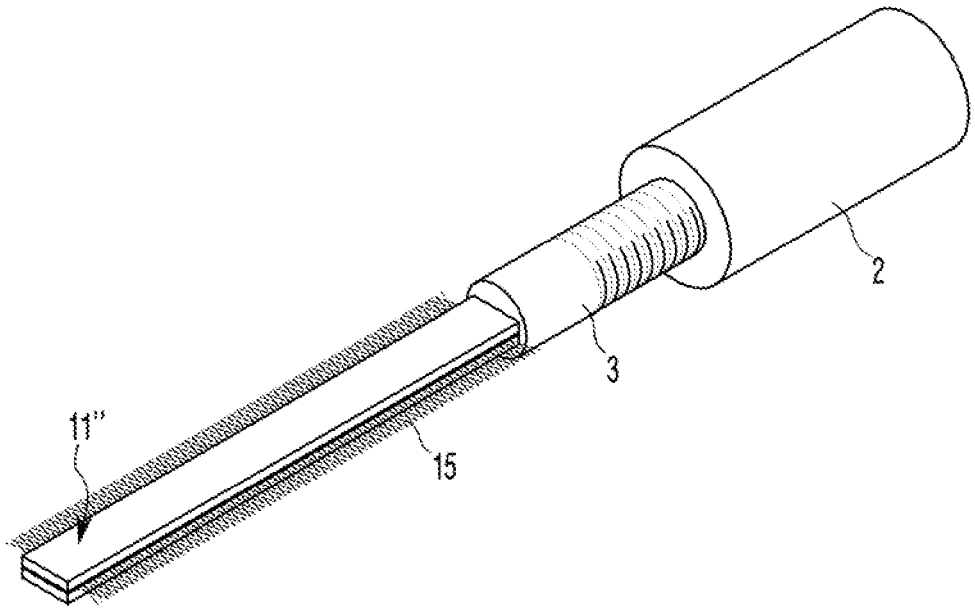
FIG. 15 is a perspective view of a third embodiment of a brush rod part according to the present invention which is connected to a handle.
Figure 16:
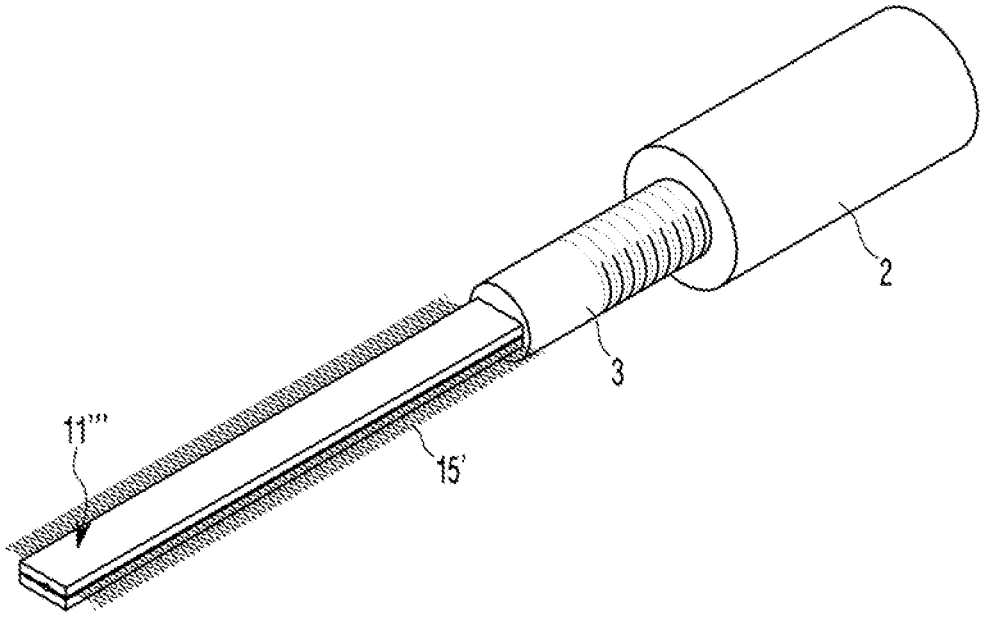
FIG. 16 is a perspective view of a fourth embodiment of a brush rod part according to the present invention which is connected to a handle.
Figure 17:
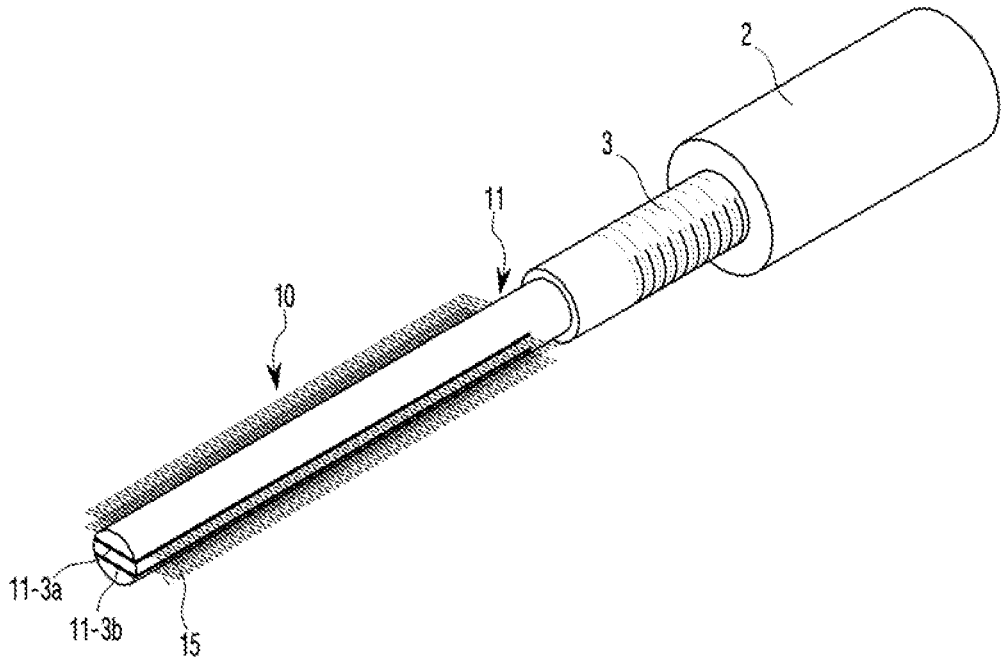
FIG. 17 is a perspective view of a first embodiment of a brush rod part according to the present invention which is added with a slot and connected to a handle.
Figure 18:
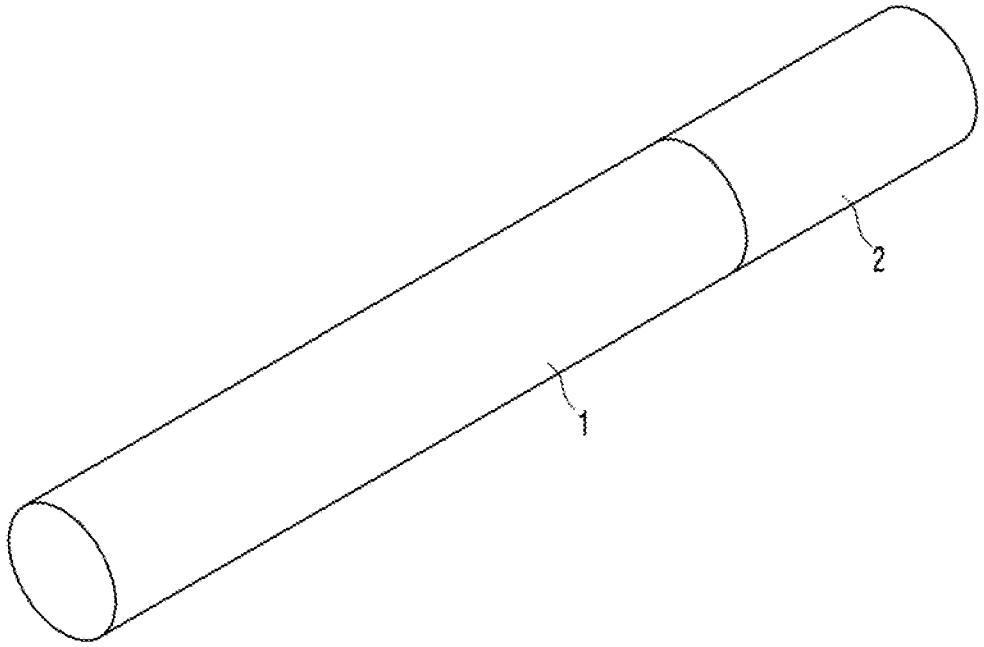
FIG. 18 is a perspective view of a mascara brush according to the present invention in which the handle is coupled to a liquid container.

FIG. 1 is a perspective view of a first embodiment of a brush rod according to the present invention, FIG. 2 is a perspective view of a slot added in the first embodiment of the brush rod according to the present invention, FIG. 3 is a perspective view of a second embodiment of a brush rod according to the present invention, FIG. 4 is a perspective view of a slot added in the second embodiment of the brush rod according to the present invention, FIG. 5 is a perspective view of a third embodiment of a brush rod according to the present invention, FIG. 6 is a perspective view of a fourth embodiment of a brush rod according to the present invention, FIG. 7 is a perspective view of a slot added in the fourth embodiment of the brush rod according to the present invention, FIG. 8 is a perspective view of a first embodiment of a method for manufacturing a mascara brush according to the present invention, FIG. 9 is a perspective view of a second embodiment of a method for manufacturing a mascara brush according to the present invention, FIG. 10 is a perspective view of a third embodiment of a method for manufacturing a mascara brush according to the present invention, FIG. 11 is a perspective view of a fourth embodiment of a method for manufacturing a mascara brush according to the present invention, FIG. 12 is a cross-sectional view for embodiments of a cutting line of a brush end part according to the present invention, FIG. 13 is a perspective view of a first embodiment of a brush rod part according to the present invention which is connected to a handle, FIG. 14 is a perspective view of a second embodiment of a brush rod part according to the present invention which is connected to a handle. FIG. 15 is a perspective view of a third embodiment of a brush rod part according to the present invention which is connected to a handle, FIG. 16 is a perspective view of a fourth embodiment of a brush rod part according to the present invention which is connected to a handle, FIG. 17 is a perspective view of a first embodiment of a brush rod part according to the present invention which is added with a slot and connected to a handle, and FIG. 18 is a perspective view of a mascara brush according to the present invention in which the handle is coupled to a liquid container.

FIG. 1 is a perspective view of a first embodiment of a brush rod according to the present invention. As illustrated in FIG. 1, a brush rod 11 is configured by one body consisting of a connection body 11-1 having one side connected with a handle 2, and a slot body 11-2 formed with a slot 11-3 into which artificial eyelashes 15 are inserted. In the drawing, the brush rod 11 has a cylinder having a circular section, but may also be formed in an elliptical cylinder or a polygonal cylinder, and such a modification is only a simple design change for those skilled in the art to which the present invention pertains. FIG. 2 is a view of a slot added in the first embodiment of the brush rod according to the present invention. As illustrated in FIG. 2, it is illustrated that two slots 11-3*a* and 11-3*b* are formed, but a plurality of slots may be formed. When the plurality of slots 11-3*a* and 11-3*b* are formed, the brush 15 may be formed as a multilayer, so that the mascara may be applied on the eyelashes easily and quickly. When the plurality of slots 11-3 is formed, a multilayered brush 15 is formed, and accordingly, there is an advantage that it may be fast and easy to apply the mascara on the eyelashes.

FIG. 3 is a perspective view of a second embodiment of a brush rod 11' according to the present invention. As illustrated in the drawing, the brush rod 11' is configured by a connection body 11-1' having one side connected with the handle 2, a flat-like slot body 11-2' extended to the other side of the connection body 11-1', and a slot 11-3' in a longitudinal direction of the slot body 11-2'. In the drawing, it is illustrated that the connection body 11-1' of the brush rod has a circular section, but the cross section may be formed in an elliptical or polygonal shape. This matter is only a simple design change to those skilled in the art to which the present invention pertains. For example, when the cross section is quadrangular, there is a difference in that all areas are formed of a quadrangular connection body 11-1' and a slot body 11-2', and a slot 11-3' having a certain length is formed.

Filaments formed in a certain pattern are inserted into the slot 11-3', and the brush 15 is formed to be integrally connected with the brush rod 11' by applying an adhesive or through vibration fusion or thermal fusion to configure a brush rod part 10'. The vibration fusion includes ultrasonic fusion or high-frequency fusion. FIG. 4 is a diagram illustrating adding the slot in the brush rod 11' of the second embodiment. As illustrated in the drawing, two slots 11-3*a*' and 11-3*b*' are illustrated, but a plurality of slots may be formed as long as the thickness is allowed. When the plurality of slots 11-3' is formed, a multilayered brush 15 is formed, and accordingly, there is an advantage that it may be fast and easy to apply the mascara on the eyelashes.

FIG. 5 is a perspective view of a third embodiment of a brush rod 11" according to the present invention. As illustrated in the drawing, the brush rod 11" is configured by one side body 11-2*a*" formed in a semi-cylindrical shape or flat plate shape, the other side body 11-2*b*" formed to be symmetrical to the one side body 11-2*a*", and a folding part 11-4" formed so that the one side body 11-2*a*" and the other side body 11-2*b*" are integrally connected and foldable to each other. The one side body 11-2*a*" and the other side body 11-2*b*" are stepped on one side connection body 11-1*a*" and the other side connection body 11-1*b*", respectively, and when the one side body 11-2*a*" and the other side body 11-2*b*" are folded based on the folding part 11-4", an interval between the one side body 11-2*a*" and the other side body 11-2*b*" becomes a slot 11-3". Artificial eyelashes formed in a certain pattern are inserted into the slot 11-3", and the brush 15 is formed to be integrally connected with the brush rod 11" by applying an adhesive or through vibration fusion or thermal fusion to configure a brush rod part 10". The vibration fusion includes ultrasonic fusion or high-frequency fusion.

FIG. 6 is a perspective view of a fourth embodiment of a brush rod 11' according to the present invention. As illustrated in FIG. 6, the brush rod 11'" is configured by an upper body 11-2*a*'" having one flat plate formed with a strap insertion groove 11-4*a*'" into which a strap 14' tying the filaments is inserted in a longitudinal center and a lower body 11-2*b*'" having a flat plate formed on one side symmetrical with the upper body 11-2*a*'". A slot 11-3'" is formed by folding the flat portions of the upper body 11-2*a*'" and the lower body 11-2*b*'". In the brush rod 11'" as the embodiment, the strap insertion grooves 11-4*a*'" and 11-4*b*'" are not formed, and a certain pattern of brush may also be disposed directly on the flat plate between the upper body 11-2*a*'" and the lower body 11-2*b*'". On one side of the upper body 11-2*a*'", an upper connection body 11-1*a*'" is integrally formed, and on one side of the lower body 11-2*b*'", a lower connection body 11-1*b*'" is integrally formed. The upper and lower connection bodies 11-1*a*'" and 11-1*b*'" are connected with the brush rod connection part 3 of the handle 2. FIG. 7 illustrates that a central body 11-2*c*'" is further added to add a slot to the brush rod 11'" of the fourth embodiment. As illustrated in FIG. 7, in the central body 11-2*c*'" having both flat sides, upper and lower strap insertion grooves 11-4*c*'" are formed, and two slots 11-3*a*'" and 11-3*b*'" are formed by folding the flat portion of the upper body 11-2*a*'", the central body 11-2*c*", and the flat portion of the lower body 11-2*b*'". Of course, the central body 11-2*c*'" is further added to form a plurality of slots 11-3'". When the plurality of slots 11-3'" is formed, a multilayered brush 15 is formed, and accordingly, there is an advantage that it may be fast and easy to apply the mascara on the eyelashes. In the embodiment, the strap insertion grooves 11-4*a*'", 11-4*b*'", and 11-4*c*'" are formed on the upper body 11-2*a*" having any one flat side, the lower body 11-2*b*'" having any one flat side to be folded with the upper body, and the central body 11-2*c*" having both flat sides, and the filaments may also be directly inserted between the upper body and the central body and between the central body and the lower body.

FIG. 8 is a perspective view of a first embodiment of a method for manufacturing a mascara brush according to the present invention. In FIG. 8, the method will be described by using the brush rod 11 of the first embodiment. As illustrated In FIG. 8, the method for manufacturing a mascara brush comprises the steps: (a) forming a certain pattern of filaments 151 by attaching the filaments 151 to an adhesive tape 14; (b) inserting the certain pattern of filaments 151 into the slot 12; (c) forming a brush 15 by injecting an adhesive into the slot 12 or vibration-fusing or thermal-fusing the slot when the certain pattern of filaments 151 are inserted into the slot 12; and (d) cutting and removing the portion attached with the adhesive tape 14 from the brush rod 11 formed with the brush 15. In step (a) illustrated in FIG. 8A, first, the filaments 151 are arranged to have a certain pattern to form the brush 15. Generally, the arrangement of the certain pattern of filaments is formed on a lower adhesive tape, and then an upper adhesive tape is attached on the top of the filaments when the arrangement is completed to fix the shape of the filaments 151. Next, in step (b) illustrated in FIG. 8B, the certain pattern of filaments 151 are inserted into the slot 11-3 of the brush rod 11. The certain pattern of filaments 151 inserted into the slot 11-3 are fixed into the slot 11-3. The interval of the slot 11-3 is formed to about 0.1 mm to 1.5 mm. Next, step (c) of FIG. 8C is a step of fixing the filaments 151 inserted into the slot 11-3. To fix the filaments 151, the slot portion is fused by injecting an adhesive into the slot 11-3 or using a vibration fusing machine 20 or thermal fusing machine 20. The vibration fusion includes ultrasonic fusion or high-frequency fusion. Accordingly, the filaments 151 are fixed to form the brush 15. In the case of the adhesive, there is no problem that the material is different, but when the vibration fusion or thermal fusion is performed, it is preferable that the brush rod 11 and the brush 15 are made of the same material. This is because different frequencies or heat are applied during vibration fusion or thermal fusion. In the embodiment, the brush rods 11, 11', and 11" of FIGS. 1 to 5 may be used. As illustrated in FIGS. 2 and 4, even when the slots 11-3*a*, 11-3*b*, 11-3*a*', 11-3*b*', 11-3*a*", and 11-3*b*" are formed in a multilayer, since the certain pattern of filaments 151 are inserted, the vibration fusion or thermal fusion is performed in the same manner. Step (d) of FIG. 8D illustrates a step of removing the adhesive tape 14 portion from the brush rod 11. When the adhesive tape 14 portion is removed, generally, one side is formed in a shape tapered toward an end when the filaments are prepared, but the other side is cut by a cutter so that the end may not be tapered. However, since the both ends of the brush have different shapes, the tapered portion of the original end may be used to apply the mascara finely and the portion with the cutting surface may be used to apply a large amount of mascara, and thus there are various advantages and there is an advantage of forming a different shape of brush. Next, step (e) illustrated in FIG. 8E may further include a step of cutting the end of the brush in a certain form to form a certain shape of cutting line 15-1 on the end of the brush 15 when the brush 15 is fixed and adhered to the brush rod 11. The cutting line 15-1 may be variously formed in the form illustrated in FIG. 11. Further, a curling may be formed without cutting the end. In addition, curled filaments may be used, and such a use may be only a simple design change in the art to which the present invention pertains.

FIG. 9 illustrates a second embodiment of a manufacturing method. In the second embodiment, the manufacturing method comprises the steps of: (a) forming a certain pattern of filaments 151' by tying filaments 151' with a strap 14'; (b) inserting the certain pattern of filaments 151' to the slot 11-3; (c) forming a brush 15 by injecting an adhesive into the slot 11-3 into which the certain pattern of filaments 151' is inserted or vibration-fusing or thermal-fusing the slot; and (d) cutting and removing the tied strap portion from the brush rod 11 formed with the brush 15. As illustrated in FIG. 9A, first, the certain pattern of filaments 151' are formed by tying knots on the strap 14' to have the certain pattern of filaments 151'. The knots formed on the strap may be formed by knitting the filaments, binding the filaments or attaching the filaments to the strap 14'. Next, FIG. 9B illustrates a step (b) of inserting the filaments 151' tied with the certain pattern of knots on the brush rod 11 into the slot 11-3. The brush rod used in step (b) may use the brush rod of FIGS. 1 to 5. As illustrated in FIGS. 2 and 4, even when the slots 11-3*a*, 11-3*b*, 11-3*a'*, and 11-3*b'* are formed in a multilayer, since the filaments 151' are inserted into the slot, the same step is applied. In FIG. 9C, when the filaments 151' are inserted into the slot 11-3, step (c) of fixing the filaments 151 to the brush rod 11 is performed. To this end, the filaments 151' are fixed by applying the adhesive on the slot 11-3 or fusing the slot 11-3 by the vibration fusion machine 20 or thermal fusion machine 20. The vibration fusion includes ultrasonic fusion or high-frequency fusion. The filaments 151' inserted into the slot 11-3 are fixed to form the brush 15. Next, FIG. 9D illustrates step (d) of cutting the strap 14' portion fixing the filaments 151' when the filaments 151' are inserted into the brush rod 11. Next, FIG. 9E illustrates step (e) of further including a step of cutting the end of the brush in a certain form to form a certain shape of cutting line 15-1 on the end of the brush 15 when the brush 15 is fixed and adhered to the brush rod 11. The cutting line 15-1 may be variously formed in the form illustrated in FIG. 11. Further, a curling may be formed without cutting the end. Further, the mascara brush may be manufactured by using the curled filaments according to the process.

FIG. 10 illustrates a third embodiment of a manufacturing method. In the third embodiment, the brush rod 11 is used, wherein an upper body 11-2*a*''' having a strap insertion groove 11-4*a*''' into which a strap 14'' is inserted and a lower body 11-2*b*''' formed to be symmetrical with the upper body 11-2*a*''' are formed in a longitudinal center, an upper connection body 11-1*a*''' formed integrally with the upper body 11-2*a*''' is further formed on one side of the upper body 11-2*a*''' and a lower connection body 11-1*b*''' formed integrally with the lower body 11-2*b*''' is further formed on one side of the lower body 11-2*b*'''. In the third embodiment, the manufacturing method comprises the steps of (a) forming a certain pattern of filaments 151'' into two parts by attaching the filaments 151'' to the strap 14'' or tying the filaments 151''; (b) adhering the certain pattern of filaments 151'' to be positioned in opposite directions to each other by attaching the straps 14'' of the two parts formed with the certain pattern of filaments 151'' with each other with an adhesive; (c) disposing the certain pattern of filaments 151'' on the lower body 11-2*b*''' by inserting the strap 14'' attached with the adhesive into the strap insertion groove 11-4*b*''' formed on the lower body and disposing the upper body 11-2*a*''' on the lower body 11-2*b*''' disposed with the certain pattern of filaments 151''; and (d) forming a brush 15'' by injecting the adhesive into the upper body 11-2*a*''' and the lower body 11-2*b*''' disposed with the certain pattern of filaments 151'' or vibration-fusing or thermal-fusing the upper body and the lower body. FIG. 10A illustrates step (a) of forming a certain pattern by tying the filaments 151'' with the strap 14''. The certain pattern is formed with two parts which are attached to each other so that the pattern may be formed on both sides. FIG. 10B illustrates step (b) of adhering the strap 14'' so that the certain pattern of filaments 151'' are formed at both sides. FIG. 10C illustrates step (c) of seating the strap 14'' on the strap insertion groove 11-4*b*''' of the lower body 11-2*b*''', disposing the certain pattern of filaments 151'', and disposing the upper body 11-2*a*''' on the certain pattern of filaments 151''. FIG. 10D illustrates step (d) of forming the brush 15'' by injecting the adhesive into the upper body 11-2*a*''' and the lower body 11-2*b*''' disposed with the certain pattern of filaments 151'' or vibration-fusing or thermal-fusing the upper body 11-2*a*''' and the lower body 11-2*b*'''. FIG. 10E illustrates further including a step of cutting the end of the brush in a certain form to form a certain shape of cutting line 15-1'' on the end of the brush 15'' when the brush 15'' is fixed and adhered to the brush rod 11'''. The cutting line 15-1'' may be variously formed in the form illustrated in FIG. 12. Further, a curling may be formed without cutting the end. When the embodiment of the brush rod 11''' of FIG. 7 is applied, the method comprises the steps of: (a) forming a certain pattern of filaments 151'' into two parts by tying the filaments 151'' with a strap 14''; (b) adhering the certain pattern of filaments 151'' to be positioned in opposite directions to each other by adhering the straps of the two parts formed with the certain pattern of filaments 151'' to each other with an adhesive; (c) disposing the certain pattern of filaments 151'' on the lower body 11-2*b*''' by inserting the strap 14'' attached with the adhesive into the strap insertion groove 11-4*b*''' formed on the lower body and disposing the central body 11-2*c*''' on the lower body 11-2*b*''' disposed with the certain pattern of filaments 151''; disposing the certain pattern of filaments 151'' on the central body 11-2*c*''' by inserting the strap 14'' attached with the adhesive into the strap insertion groove 11-4*c*''' formed on the upper surface of the central body 11-2*c*'''; and disposing the upper body 11-2*a*''' on the central body 11-2*c*''' disposed with the certain pattern of filaments 151''; and (d) forming a brush 15'' by injecting the adhesive into the upper body 11-2*a*''' disposed with the certain pattern of filaments 151'', the central body 11-2*c*''', and the lower body 11-2*b*''' or vibration-fusing or thermal-fusing the upper body, the central body and the lower body. Since the process is the same as the embodiment of FIG. 10 except that the central body 11-2*c*''' is added, a detailed description will be omitted. The vibration fusion includes ultrasonic fusion or high-frequency fusion. In addition, the brush 15'' may be formed with a constant curling, and filaments having curling may also be used.

FIG. 11 illustrates a fourth embodiment of a manufacturing method according to the present invention. In the fourth embodiment of the manufacturing method, a brush rod''' is used, in which the strap insertion grooves 11-4*a*''' and 11-4*b*''' are omitted in the brush rod 11''' of FIG. 6. Accordingly, the brush rod 11''' is prepared by consisting of the upper body 11-2*a*''' formed with any one flat side to be disposed or attached with the strap and the lower body 11-2*b*''' formed with a flat plate corresponding to the flat plate of the upper body 11-2*a*'''. The manufacturing method of the fourth embodiment comprises the steps of: (a) forming a certain pattern of filaments 151' by attaching the filaments 151' to a strap 14' or tying the filaments 151' with the strap 14'; (b) disposing the strap 14' formed with the certain pattern of filaments 151' on a flat plate of a lower body 11-2*b*''' to have a certain pattern at one side or both sides; (c) disposing a flat plate of an upper body 11-2*a*''' on the flat plate of the lower body 11-2*b*''' disposed with the certain pattern of filaments 151'; and (d) forming a brush 15' by injecting an adhesive into the upper body 11-2*a*''' and the lower body 11-2*b*''' disposed with the certain pattern of filaments or vibration-fusing or thermal-fusing the upper body 11-2*a*''' and the lower body 11-2*b*'''. FIG. 11A illustrates step (a) and illustrates a step of forming a certain pattern by attaching or tying the filaments 151' with the strap 14'. FIG. 11B illustrates step (b) and illustrates a step of disposing the certain pattern of filaments 151' on the flat plate of the lower body 11-2*b*'''. The certain pattern of filaments 151' may be disposed on the lower body by applying the adhesive on the strap 14' and may be disposed without the adhesive. FIG. 11C illustrates step (c) of disposing the upper body 11-2*a*''' on the lower body 11-2*b*''' disposed with the certain pattern of filaments 151'. The upper body and the lower body are folded so that the position of the certain pattern of filaments 151' may be fixed. FIG. 11D illustrates step (d) of adhering the upper body and the lower body with the adhesive or adhering the upper body and the lower body by the vibration fusion machine 20 or the thermal fusion machine 20. FIG. 11E illustrates step (e) of further including a step of cutting the end of the brush in a certain form to form a certain shape of cutting line 15-1' on the end of the brush 15' when the brush 15' is fixed and adhered to the brush rod 11''' as illustrated in FIG. 12. The cutting line 15-1' may be variously formed in the form illustrated in FIG. 12. Further, a curling may be formed without cutting the end. Further, the curled filaments may also be formed.

FIG. 12 illustrates that the certain cutting line 15-1 is formed at the end of the brush 15. As illustrated in the drawing, FIG. 12A illustrates an example of an arch-shaped cutting line 15-1*a* and FIG. 12B illustrates an example of a wave-shaped cutting line 15-1*b*. FIG. 12C illustrates a convex-shaped cutting line 15-1*c*, FIG. 12D illustrates a concave-shaped cutting line 15-1*d*, and FIG. 12E illustrates a straight-shaped cutting lien 15-*le*. Even in addition to these shapes, various shapes of cutting lines may be formed. That is, in the present invention, both sides of the brush 15 may be formed with different shapes of cutting lines, and both sides of the brush 15 may also be formed by varying an amount applied with the mascara.

FIG. 13 illustrates connecting the brush rod part 10 of the first embodiment to the handle 2. As illustrated in FIG. 13, the brush rod part 10 may be inserted or fastened into the connection part 3 of the handle 2. FIG. 14 illustrates connecting the brush rod part 10' of the second embodiment to the connection part 3 of the handle 2, and the brush rod part 10' may be inserted or fastened into the connection part 3 of the handle 2. FIG. 15 illustrates that the brush rod part 10'' of the third embodiment is connected to the connection part 3 of the handle 2. In the case of flat plate type, the brush rod part may be attached through an adhesive or the like or through vibration fusion or thermal fusion. FIG. 16 illustrates connecting the brush rod part 10''' of the fourth embodiment to the connection part 3 of the handle 2, and the brush rod part 10''' may be attached to the handle through an adhesive or the like or through vibration fusion or thermal fusion. FIG. 17 illustrates an example in which the slot 11-3 is formed in a multilayer in the brush rod 11 of the first embodiment. Even in the embodiment of FIG. 2 or 4, the slot has the same shape, and thus, the detailed drawing will be omitted.

FIG. 18 illustrates that the handle 2 according to the present invention is coupled to the liquid container 1. The mascara liquid is injected to the liquid container 1 and may be evenly applied on the user's eyelashes by using the mascara brush 30 connected to the handle 2.

As described above, the filaments used in the brush of the present invention may use bristles or hairs of animals as natural materials and also use filaments used for artificial eyelashes or wigs or synthetic fibers. The type of related synthetic resins may include polypropylene (PP), polyethylene terephthalate (PET), poly butylenes terephthalate (PBT), nylon, etc. Further, when the brush rod uses the same material as the filaments, it may be advantageous during ultrasonic fusion or a thermal inclusion. However, when the slot is attached using the adhesive, the filaments and the brush rod may not be formed of the same material.

While the embodiments are exemplified above, it will be apparent to those skilled in the art that the present invention may be embodied in many other forms without departing from the spirit or scope of the present invention. Therefore, the above-described embodiments are to be considered illustrative and not restrictive, and all embodiments within the scope of the appended claims and their equivalents are intended to be included within the scope of the present invention.

INDUSTRIAL APPLICABILITY

The present invention relates to a mascara brush and a method for manufacturing the same, and a mascara brush manufactured by coupling filaments formed in various patterns to a body of the mascara brush can be applied to a cosmetic industry as a final product and has large industrial applicability.

The invention claimed is:

1. A mascara brush comprising:

a brush rod part formed with a certain pattern of brush;

a handle connected to the other end of the brush rod part; and a liquid container into which the brush rod part having the brush is inserted, wherein the brush rod part comprises: a brush rod having a certain length of a slot with a certain interval, and a brush comprising a certain pattern of filaments, wherein the certain pattern of filaments are inserted into and adhered to the slot, wherein the brush rod comprises one side body formed in a certain length, the other side body formed to be symmetrical with the one side body, and a folding part formed to be foldable so that ends of the one side body and the other side body are connected to each other, wherein the one side body and the other side body are folded to form a slot.

2. The mascara brush of claim 1, wherein one or more slots are formed.

3. The mascara brush of claim 1, wherein the brush is formed by attaching one side of the filaments to an adhesive tape to form a certain pattern, inserting the certain pattern of filaments into the slot to adhere the certain pattern of filaments together with the slot with an adhesive or through vibration fusion or thermal fusion, and then cutting and removing the adhesive tape portion.

4. The mascara brush of claim 1, wherein the brush is formed by dividing the filaments into two parts with a strap made of the same material as the filaments to form a pattern, adhering the strap of the two parts with the pattern with an adhesive to form a certain pattern of filaments, inserting the certain pattern of filaments attached to the strap into the slot to adhere the filaments together with the slot with the adhesive or through vibration fusion or thermal fusion.

5. The mascara brush of claim 4, wherein the brush rod comprises an upper body having any one side formed in a flat plate, and a lower body having any one side formed in a flat plate so as to be folded with the flat plate of the upper body, wherein the upper body and the lower body are folded to form a slot.

6. The mascara brush of claim 5, wherein longitudinal strap insertion grooves are provided on the flat plates of the upper body and the lower body.

7. The mascara brush of claim 5, further comprising: a central body between the upper body and the lower body, wherein the central body has strap insertion grooves formed on an upper surface and a lower surface thereof, respectively, and the upper body, the central body, and the lower body are folded to form a slot.

8. The mascara brush of claim 1, wherein the brush is formed by tying the filaments with the strap to form a certain pattern, inserting the certain pattern of filaments into the slot to adhere the certain pattern of filaments together with the slot with an adhesive or through vibration fusion or thermal fusion, and then cutting and removing the strap portion.

9. The mascara brush of claim 1, wherein the brush rod comprises a connection body connected with a handle, a slot body formed to extend to the other side of the connection body, and one or more slots formed with a certain length on the slot body.

10. The mascara brush of claim 1, wherein the brush has a cutting line in which the end is cut in a straight shape, a convex shape, a concave shape, a shape combined with the convex shape and the concave shape, and a zigzag shape, or maintains an original shape without forming the cutting line.

11. A method for manufacturing a mascara brush using a brush rod formed in a certain length and with a slot into which a certain pattern of filaments are inserted, the method comprising the steps of:

(a) forming a certain pattern of filaments by attaching the filaments to a strap or tying the filaments with the strap;

(b) inserting the certain pattern of filaments into the slot;

(c) forming a brush by injecting an adhesive into the slot inserted with the certain pattern of filaments or vibration-fusing or thermal-fusing the slot; and (d) cutting and removing the strap portion attached with the filaments or tied with the filaments from the brush rod formed with the brush.

12. The method of claim 11, further comprising:

(e) forming a certain shape of cutting line by cutting an end of the brush in a certain shape when the brush is adhered to the brush rod.

* * * * *